United States Patent [19]

Wallussek et al.

[11] Patent Number: 4,596,293

[45] Date of Patent: Jun. 24, 1986

[54] TARGETABLE DRILL WITH PRESSURE TELEMETERING OF DRILL PARAMETERS

[75] Inventors: Heinz Wallussek, Herdecke; Martin Wiebe, Hattingen, both of Fed. Rep. of Germany

[73] Assignees: Bergwerksverband GmbH; Schwing Hydraulik Elektronik GmbH & Co., both of Essen-Kray, Fed. Rep. of Germany

[21] Appl. No.: 632,435

[22] Filed: Jul. 19, 1984

[30] Foreign Application Priority Data

Jul. 19, 1983 [DE] Fed. Rep. of Germany ..... 3325962

[51] Int. Cl.[4] ..... E21B 44/00; E21B 47/02

[52] U.S. Cl. ..... 175/27; 367/85; 33/307; 175/45

[58] Field of Search ..... 175/27, 24, 25, 45, 175/73, 317, 26, 61; 173/2, 3, 4, 39; 367/80, 81, 83, 85, 86; 33/304, 307, 313; 73/151, 153

[56] References Cited

U.S. PATENT DOCUMENTS

| | | | |
|---|---|---|---|
| 3,841,420 | 10/1974 | Russell | 175/73 X |
| 4,351,037 | 9/1982 | Scherbatskoy | 367/85 |
| 4,386,422 | 5/1983 | Mumby et al. | 367/85 |
| 4,407,374 | 10/1983 | Wallussek et al. | 175/24 |
| 4,513,403 | 4/1985 | Troy | 33/307 X |

*Primary Examiner*—Stephen J. Novosad
*Assistant Examiner*—David J. Bagnell
*Attorney, Agent, or Firm*—Karl F. Ross; Herbert Dubno

[57] ABSTRACT

A dirigible drilling head is provided with a hydraulic pulser in its rotating inner tube in the form of a spindle piston which can obstruct the flushing medium passage and is displaced by a hydraulic circuit including a hydraulic valve. The hydraulic valve is in turn actuated by a miniature electronic circuit so that a variety of input parameters from respective sensors can be delivered to the circuit and transformed into respective hydraulic pulses which are monitored by a differential pressure pickup connected to the line feeding the flushing liquid to the string.

15 Claims, 10 Drawing Figures

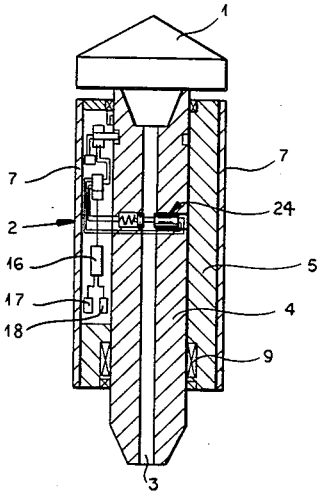

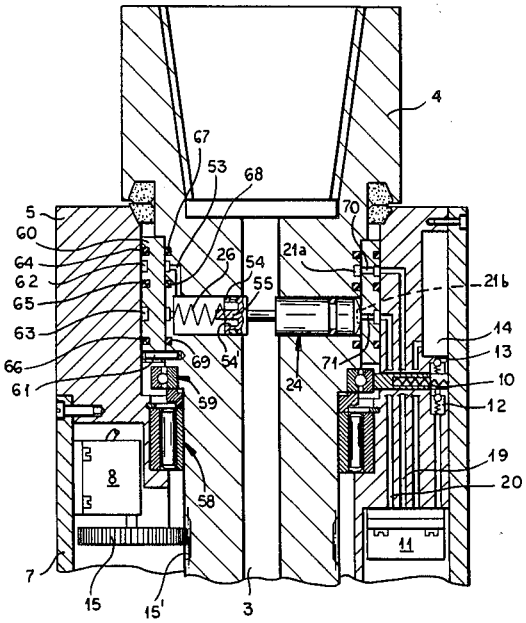

TARGETABLE DRILL WITH PRESSURE TELEMETERING OF DRILL PARAMETERS

FIELD OF THE INVENTION

The present invention relates to a targetable or homing drill for subterranean applications primarily or for wherever directed drilling is desired and, more particularly, to a drill of this type with telemetering of data to a location remote from the bore.

BACKGROUND OF THE INVENTION

The targetable or homing drill is a drill which can be directed to follow a certain path or can signal deviations from this path, or can automatically compensate for deviations from a predetermined path so that the orientation of the drill is automatically adjusted.

Such a drill generally comprises a bit or cutter which can be mounted upon an inner tube rotatable in an outer tube at the leading end of the drill string or head, the head being connected by other lengths of tube to a source of a drilling fluid which is piped through the drill string to the head.

The rotation of the inner tube by an external drive or the rotation of the bit or cutter by an electric motor, allows the bit to cut away rock strata into which the drill advances and the drilling detritus and spent mud can pass through channels between ribs of an outer tube of the head to the mouth of the bore. The outer tube can be provided with means for adjusting the orientation of the head to ensure drilling along a predetermined path.

Such drills can also be provided with telemetering facilities enabling parameters of drill operation to be transmitted to a remote location for evaluation.

The information which is thus telemetered to the evaluation station can comprise parameters detected by sensors in the drill and can represent parameters of the drilling operation, i.e. the drilling direction or deviations therefrom, as well as parameters related to the functions of the various devices or components of the drill string.

For example, when the drill string is of the direction-correcting type, direction correction can be effected by ribs which may be swingably mounted on the outer tube of the drill string and which can be actuated by hydraulic means, e.g. individual cylinders in the outer tube, under the control of a hydraulic circuit. It is important to monitor the operations of these hydraulic elements and the hydraulic circuit as well.

Reference may be had to a known correcting drill, namely that described in German patent document-open application DE-OS No. 30 00 239.2. In the outer tube of this drill string for control of the hydraulically actuatable cylinder for the control ribs, a plurality, preferably two, inclinometers are provided and are oriented in two mutually perpendicular vertical measuring planes.

The measurements from these inclinometers not only serve as the actual value signals for automatic control of the ribs and hence the orientation of the string during further drilling but are transmitted by telemetering to a station at the mouth of the bore. The telemetering is here effected by electrical signals which are transmitted through cable and trained along with the drill or are transmitted via conductors formed in the drilling tubes. These signals are highly precise but the system has the disadvantage that contact between the tubes may be problematical and there is a danger to a cable entrained along with the drill so that for mechanical reasons this earlier system has been found to be unreliable.

In German patent document-open application DE-OS No. 29 41 102, a rotary drill string is described in which the telemetering device utilizes a hydraulic converter which transforms electrical signals into pressure pulses of the flushing string, the pressure-modulated flushing string serving as a carrier for pressure signals. However, the recognition of these signals is poor in the prior art device, the ability to transmit data is limited and generally the system is ineffective because sharp rising and falling flanks are not observed on the pressure pulses.

OBJECTS OF THE INVENTION

It is the principal object of the present invention to provide a dirigible drill string of the type described which has an improved system for the telemetering of data whereby the disadvantages of prior art systems are avoided.

Another object of the invention is to provide an improved drill string with data telemetering capabilities.

SUMMARY OF THE INVENTION

These objects and others which will become apparent hereinafter are attained, in accordance with the present invention, in a drill string of the dirigible type described, wherein inclinometers are provided for the control of guide ribs by a hydraulic circuit in the head of the drilling string, in which the telemetering is effected via the flushing medium which traverses the string. According to the invention, the flushing medium passage extends through an inner tube of the drill string, which is surrounded and rotatable relative to an outer tube coaxial therewith, and a hydraulic converter for transforming the electrical signal into hydraulic pressure pulses in the flushing medium, the hydraulic converter comprising a radial bore or recess formed in the inner tube and extending across the flushing medium passage, a spindle piston displaceable in this recess and provided with at least one piston portion which is hydraulically energized by a control valve so that another portion of this piston can protrude from the recess into the path of the flushing medium across the flushing medium passage to generate a pulse in the flushing medium.

The advances in electronics in recent years allow miniaturized electronic components of the system of the present invention to be readily incorporated into the drilling head and to control the magnetic valve which operates the spindle piston according to the invention so that extremely sharp flanks can be formed on the leading and trailing sides of each pressure pulse. Thus high frequency pressure pulses with extremely sharp definition can be generated utilizing the spindle piston hydraulic pulse generator according to the invention.

Furthermore, the invention permits accumulation of more elements of data than has been possible heretofore. For example, apart from the outputs of the inclinometers, a number of items of other data relating to the operation of the drill can be developed by various measuring units and monitors and can be evaluated in the outer tube which is not particularly mechanically stressed to generate signals which are converted into hydraulic pulses applied to the flushing medium stream utilizing the spindle piston described.

The system thus serves not only to monitor the direction of the drill but also the details of the functioning thereof and especially the functioning of the hydraulic and electrical units thereof.

According to another feature of the invention, a spring bears against one end of the spindle piston and the spindle piston is divided into two piston portions by a spindle shaft. A 2-port/3-position distributing valve can be used to control the actuation of the spindle piston although a 4-port/3-position distributing valve is preferred.

The inner tube is preferably surrounded by a sleeve which is rotationally connected thereto, i.e. rotates with the inner tube, to effect fluid communication between the spindle piston and the electromagnetic valve.

The provision of the spindle piston so that it spans the flushing passage is preferred for relatively slender drilling strings and inner tubes while a one-sided provision of the spindle piston can be used where larger diameters are involved. The sleeve greatly facilitates sealing and communication since it allows use of grooves for fluid communication between the rotating inner tube and the nonrotating outer tube.

A hydraulic pump is preferably disposed in the nonrotating outer tube and can be electrically energized through the power circuitry previously mentioned. The supply to the piston is more reliable when, according to a feature of the invention, an annular groove communicates directly with the aforementioned recess between the inner tube and the nonrotating outer tube.

The electric current for the system is preferably generated by a low-speed generator in the outer tube which is driven by rotation of the inner tube. The hydraulic pump is provided with a pressure relief valve which drains excess pressure to a hydraulic tank.

For highly precise control of the pulse-generating piston, in the hydraulic line between the hydraulic pump and the piston, a magnetic valve is provided which responds to the electronic circuitry previously described and generates precise piston strokes and respective pulses corresponding to the desired values.

In addition to the inclinometers, direction sensors, temperature, pressure and voltage measuring sensors can be provided which can be disposed in groups or individually at various locations of the outer and/or inner tubes.

These sensors can respond to all of the important parameters of operation of the drill and the bit and can transmit all of the data which is introduced to the evaluating station.

The evaluating station can be provided with a differential pressure pickup which is provided with a display and, preferably, a printer.

The pressure pulses can thus be converted to electrical pulses and displayed, read and where desired, stored.

All of the components are involved in the electrical aspects described above and supplied with electrical energy from the generator via a rectifier and voltage regulator and/or voltage converter.

A transmitter can be provided and can be synchronized with a receiver for monitoring of the synchronization through one or two synchronizing pulses before each measurement cycle.

The drill can be used to form horizontal and inclined bores without special additional devices and this is especially the case when the inclinometer is an electronically supported accelerometer and the direction detector is a mechanically calibrated magnetometer. Both of these devices are not sensitive to the operation of the string except directionally and provide a precise evaluation of the direction of movement and inclination of the string.

For drilling to follow rock strata, it is advantageous to provide the outer tube with one or more gamma ray sensors to detect orientation in the vertical and horizontal directions.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 4:
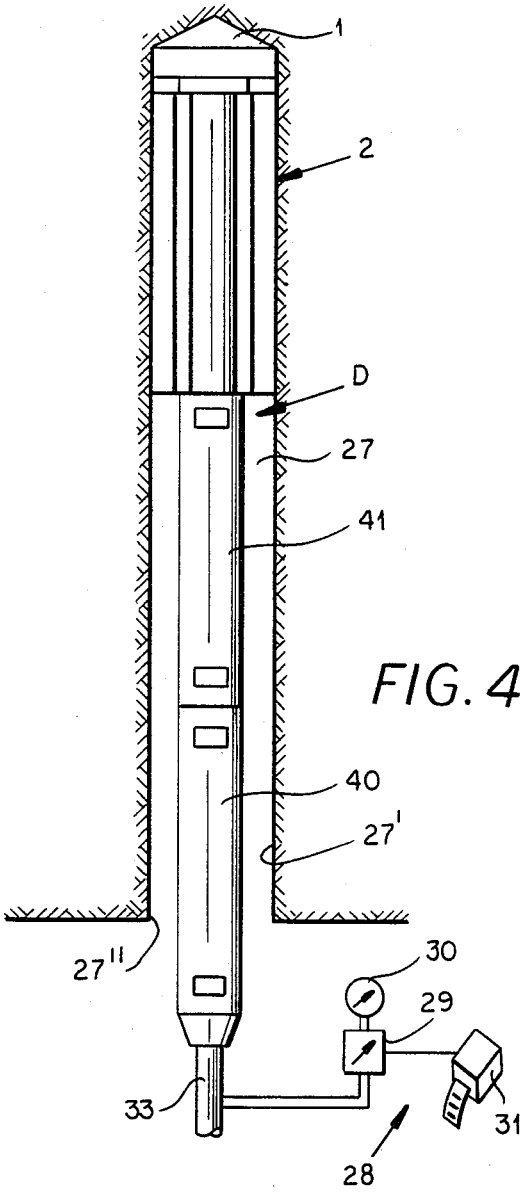
FIG. 4 is a simplified section through a subterranean structure illustrating the operation of the apparatus of the invention and showing the components associated with the drilling string.

Referring first briefly to FIG. 4, it can be seen that a bore 27 can be drilled in a rock structure 27' for mining or other applications in a targeted manner utilizing a drill string D which can comprise two drilling tubes 40 and 41 which are connected to the drill head member 2 of the drill carrying the drilling crown or bit 1 which may be rotated to bite away the rock in the usual manner, the detritus being flushed back through channels along member 2 and through the bore 27 to the mouth 27'' thereof which can be in a mine shaft, tunnel or gallery.

The drilling mud is supplied to the drilling bit 1 via the tubes 40 and 41 and the rotary drilling motion is imparted to the bit 1 via an inner tube 4 (FIG. 1) which can be driven by means not shown and encloses the flushing passage 3 through which the drilling mud is supplied to the drilling head.

While an upward drilling operation has been shown in FIG. 4, it will be understood that the principles of this invention are applicable to any drilling orientation and to deep well drilling as well as drilling for mining applications.

The inner tube or pipe 4 is disposed concentrically in an outer tube 5 and is journaled therein as represented diagrammatically by the bearings 9. The outer tube 5 is provided with outer swingably journaled guide ribs or bars 7 which can engage the walls of the bore to hold the outer tube against rotation as the bit 1 is rotated so that relative rotation is effected between the inner tube 4 and the outer tube 5.

The outer tube 5 receives the working cylinders for the control bars which are not shown in any detail but which, when appropriately actuated by the hydraulic controls, can serve to direct the progress of drilling.

Figure 1:
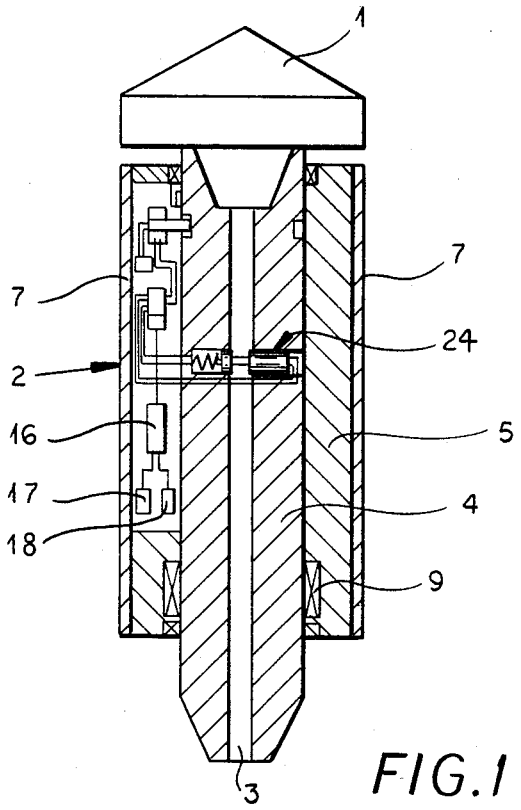
FIG. 1 is an axial cross-sectional view through an initial drill string length provided with the drill head for a homing or targetable rock drill for mining and other subterranean applications in accordance with the invention.

The outer tube 5 also includes a number of measuring and monitoring devices which have been represented generally at 17 and 18 in the drawing and have also been shown only diagrammatically in FIG. 1.

These measuring and monitoring devices can include, inter alia inclinometers 17 and devices 18 (*a–d*) which monitor the direction and bottom hole temperature and pressure of the bore 27 and supply measurement signals to an electronic controller to effect steering control of the drill to maintain a preplanned drilling direction.

A pump 10 built into the outer tube (see FIG. 3) generates the hydraulic operating pressure for the steering action and can be driven directly by the rotating tube 4 or electrically by an electric output from a generator 8. The electric generator 8 has a pinion 14 connected with the generator rotor and meshing with external gearing 15′ of inner tube 4 so that the latter drives the generator.

This arrangement ensures that the operation of the hydraulic units and the energy for the measurements and their conversions to hydraulic control will be independent from the kinetic energy of the flushing stream.

The generator 8 also serves to supply the energy for the signals of the measuring and monitoring units and thus for control of a three-position, four-port distributing valve 11 which controls the hydraulic medium to the spindle piston 24. It will be evident that a 3/2 distributing valve can also be employed with only minor hydraulic circuit modifications.

Figure 6:
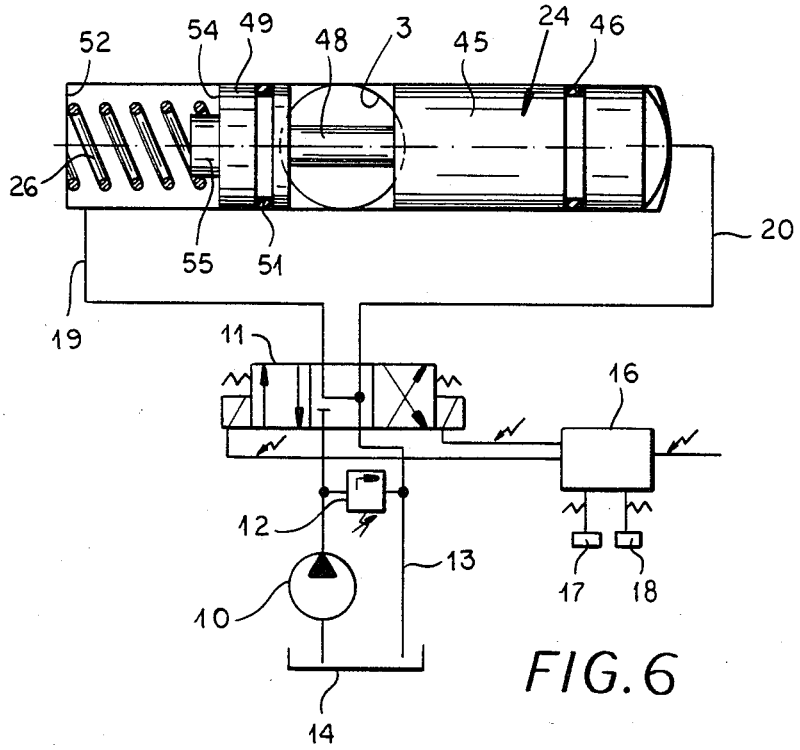
FIG. 6 is a flow diagram showing the control system for the pulse piston.
Figure 7:
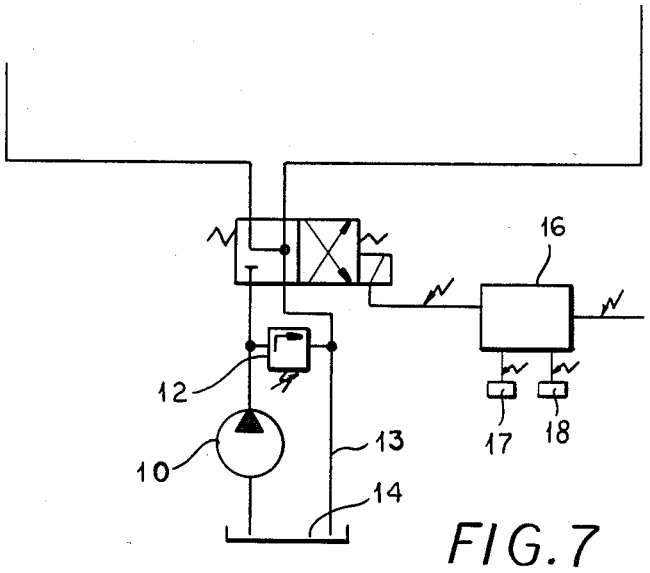
FIG. 7 is a diagram illustrating another embodiment of the hydraulic control system for the pulse piston.

Referring to FIG. 6 it can be seen that pump 10 draws its hydraulic fluid from the reservoir or tank 14 to which excess fluid is returned by a pressure relief valve 12 in a bypass to the return line 13. The magnetic valve 11 is energized by the electronic circuit 16 which receives its electrical input signals from the monitors or sensors 17 and 18 previously described. The inputs to the controller 16 may, apart from receiving signals from the inclinometers, also include signals from monitors for the various units in the outer tube. Thus the information evaluated by the circuit 16 includes not only the drilling direction information relating to the bore, but also status information as to the operation of the various units in drill head 2. This data can include measurements of wear, potential defects in the hydraulic/electrical or electronic control elements, etc. The output of the electronic circuit 16 is thus a train of electrical control signals which are converted into pressure signals by the spindle piston 24.

Figure 2:
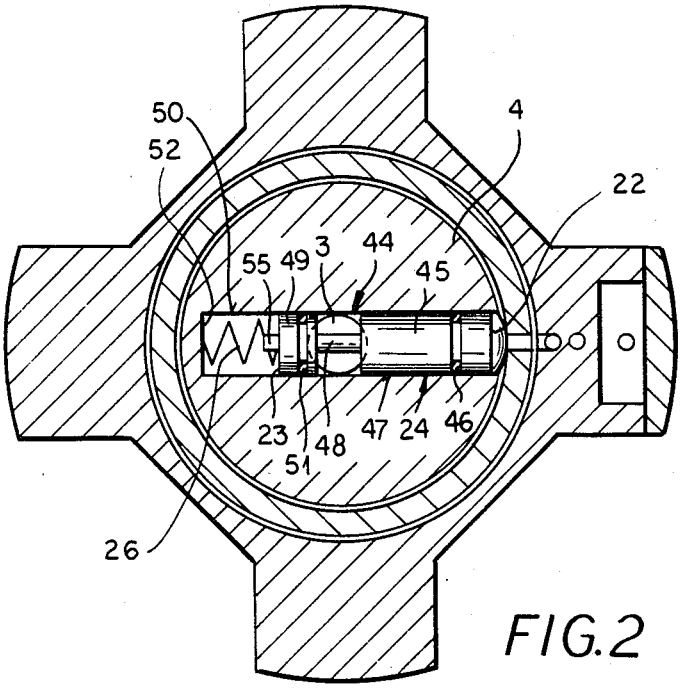
FIG. 2 is a transverse section through this drill string.
Figure 3:
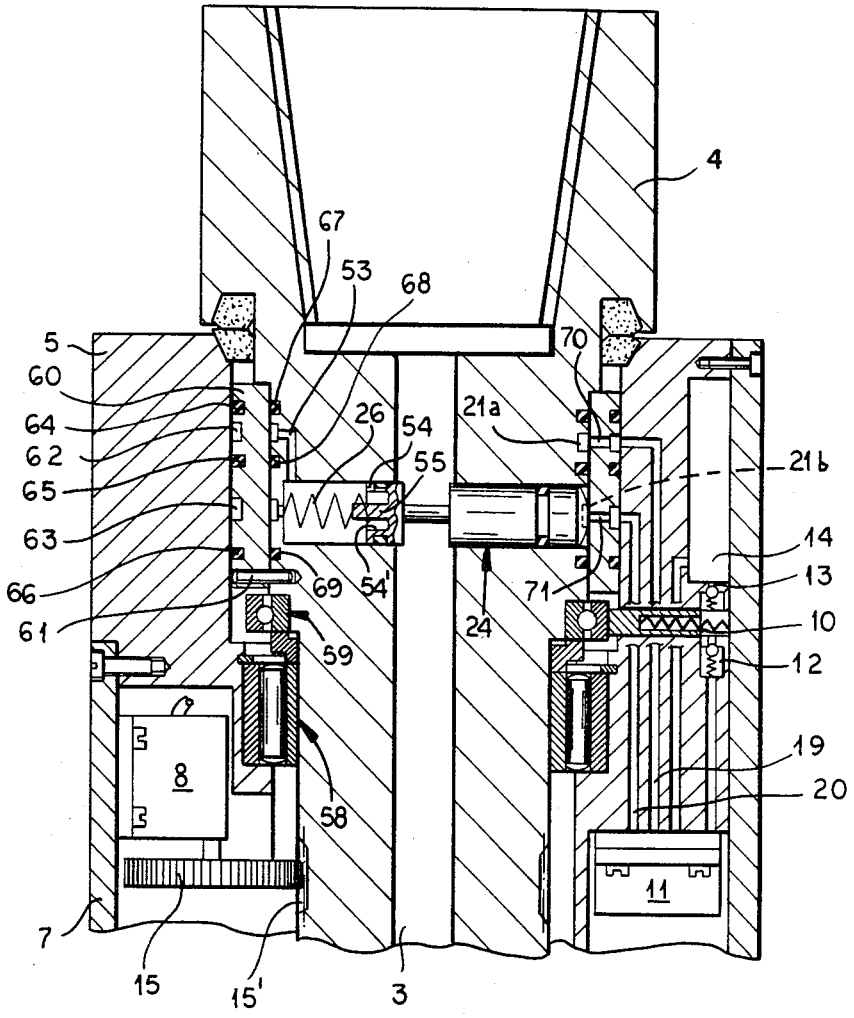
FIG. 3 is a longitudinal section through a portion of the drill string.

In the embodiments of FIGS. 2, 3 and 6, the spindle piston is a double piston whose details may be ascertained from FIGS. 2 and 3. The spindle piston 24 is received in a recess 44 which has, over the major portion of its length, a uniform diameter and traverses the inner tube 4 extending transversely to and across flushing passage 3 (FIG. 2).

The piston 24 is subdivided into a piston portion 45 having an O-ring 46 subdividing it into two parts within one-half 47 of the recess 44 and cooperating with a passage 21*b*. The other part of the piston 24, connected to the first by a small-diameter shaft 48, is a short piston portion 49 which is shiftable in the other half 50 of the recess 44 and is sealed in the latter by an O-ring 51.

The recess 44 terminates at a seat 52 for a compression coil spring 26 which biases the piston 24 to the right (FIGS. 2 and 3).

An axial transverse bore 53 (FIG. 3) forms a hydraulic connection to the exterior from the second half 50 of the recess 4.

The coil spring 26 engages within an apron 54 and surrounds a pin 55 rising from the bottom of the recess 54′ receiving the spring. The pin 55 projects beyond the apron 54 to the left.

Figure 8:
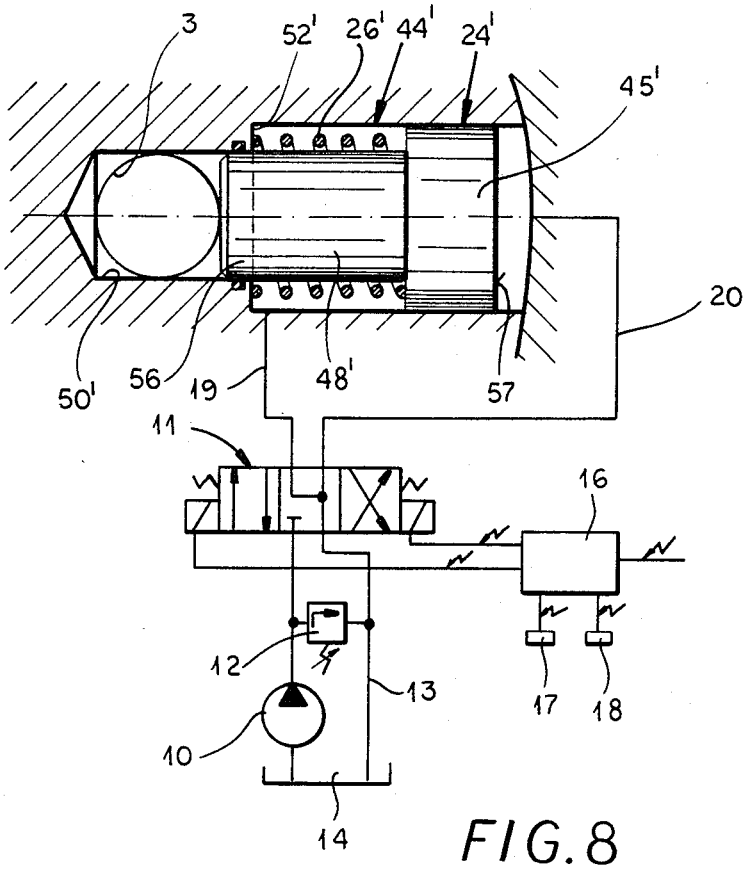
FIG. 8 is a flow diagram showing a control system for a pulse piston hydraulically energized and with one-sided support.

The spindle shaft 48 always lies across the flushing passage 3. To minimize the throttling effect at the spindle piston, the piston 24′ of FIG. 8 differs from that previously described in that it is disposed only at one side of the flushing passage 3. In this case the recess 44′ extends radially outwardly to only one side of the flushing passage 3 and the piston 24′ has a portion 45′ of the full diameter of the recess 44′ and a portion 48′ of substantially smaller diameter, surrounded by a spring 26′ bearing the piston 24′ to the right. The spring 26′ is seated against an annular shoulder 52′ where the recess 44′ is stepped to a smaller diameter 50′ corresponding to the diameter of the spindle 48′

The piston 24′ is thus a differential piston biased to the left by hydraulic pressurization because of the greater area of the surface 57 of this piston than the oppositely effective surface area.

Normally the end 56 of the piston remains out of the flushing flow and only enters into the flushing stream when the hydraulic force overcomes the force of spring 26.

Referring again to FIG. 3 it will be apparent that the hydraulic medium required for displacing the spindle piston 24 is supplied from the outer tube 5 to the inner tube 4 and hence the recess 44.

To this end, ahead of the pair of bearings 58 and 59 at the bit end of the drill head 2, a sleeve 60 is mounted on the inner tube 4 and is held against rotation relative thereto by a pin 61, i.e. the sleeve 60 rotates with the inner tube 4.

This sleeve 60 is provided with outwardly open annular grooves 62 and 63 serving respectively for pressurization and pressure relief of the spindle piston 24, sealing rings 64, 65 and 66 being provided on opposite axial sides of these grooves. Corresponding sealing rings 67, 68 and 69 are provided sealingly between the sleeve 60 and the inner tube 4.

Radial bores 70 and 71 communicate with these passages and via respective axial bores 19 and 20 in the outer tube 5 with the magnetic valve 11.

When the magnetic valve 11 is actuated and the corresponding passage 21*a* or 21*b* is pressurized or depressurized, the hydraulic medium is either supplied to the end 22 of the spindle piston and discharged from the space behind surface 23 of the port portion 49 thereof so that the spindle piston is momentarily displaced opposite to the effect of the spring or, conversely the other directions are reversed to allow the spindle piston to be restored to the starting position maintained by the spring 26.

The brief obstruction of the flushing passage 3 which is thus generated can result in a sharp throttling or even a momentary total obstruction of this flow passage.

This results in a sharp pressure increase in the flow passage which, following reversal of the valve 11, results in a rapid decay because the spring 26 restores the spindle piston in an equally brief time to its starting position.

Figure 5:
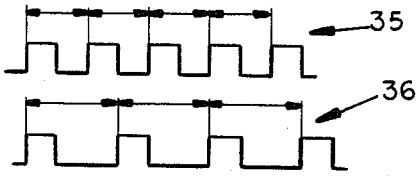
FIG. 5 is a pulse diagram in simplified form illustrating the pressure pulses which are used in accordance with the invention.

In response to the magnetic valve 11, therefore, rectangular pressure pulses as shown at 35 can be generated in a predetermined cadence or frequency with the indicated pulse spacing of FIG. 5. The double-headed arrows represent the period of the pulse and this period determines a measurement value or measurement signal to which a pulse converter 29 (FIG. 4) can respond.

In other words, by briefly blocking or throttling the flow of the flushing liquid, pulses are transmitted back to the converter 29 at a pulse frequency identifying a particular parameter and with a pulse duration which can represent a magnitude of that parameter for evaluation.

The pulse train 36 also shown in FIG. 5 shows pulses of a different frequency and hence period so that this pulse train represents another parameter.

By appropriate selection of the frequencies, values of various parameters which may represent measured values or control signals can be imposed upon the flushing string and detected by the converter 29 which transforms these pressure signals into electrical signals for identification and evaluation.

A control station 28 (FIG. 4) can be provided with a display represented at 30 and a printer 31 so that the parameters and their values can be identified and evaluated.

The converter 29 provided in the drilling mud feeding passage 33 can also be located at the station 28 and the display or evaluation circuits can be provided elsewhere, if desired, e.g. above ground since the signals transmitted thereto can be electrical signals from the converter 29.

By way of example, the targetable drill string of FIG. 3 for mining applications can be designed to form a bore 27 of a diameter of 8½ inches using the following operating conditions.

The generator 8 is a slow rotor generator driven at 60 revolutions per minute and supplies three-phase alternating current of about 24 volts with a power of about 40 watts. In place of the alternating current generator 8, it is possible also to use two direct current motors.

The electric circuitry built into the drill head 2 includes a rectifier 80 for converting the alternating current into direct current and a voltage regulator 81 for maintaining a supply voltage of 24 volts. The dc-dc voltage converter 82 supplies ±12 volts direct current for the measurement on opposite sides of a zero reference or ground point.

Apart from the power circuitry, the electronic circuit includes a frequency generator for feeding the direction sensors, a rectifier for rectifying the measurement signals outputted by these sensors and a set point/actual value comparator in the form of a window or threshold circuit for effecting control of the direction in accordance with conventional servomechanism practices and for controlling the magnetic valve and the hydraulic fluid or oil flow to the control piston of the direction control ribs.

Apart from the described power and control electronics, a transmitter circuit can be provided for receiving and retransmitting measured values or signals from the various monitors. In general, this circuit responds to the signals from two inclinometers for vertical bores, for example, and which can be energized by control voltages of ±5 volts. In addition, the monitored parameters for which signals are transmitted in the manner described to the pulse converter 29 can include the temperature of the hydraulic medium which can be measured at two different locations and can be converted to a voltage ranging from 0 to 5 volts, the hydraulic tank pressure which can range from 0 to 5 bar and which is measured by an appropriate transducer outputting a voltage signal of 0 to 5 volts.

The hydraulic system pressure of 0 to 100 bar can also be transformed into a measurement parameter represented by 0 to 5 volts direct current while the hydraulic pressure in the measurement transfer system of 0 to 60 bar at the spindle piston, for example, can also be converted to a voltage of 0 to 5 volts direct current. The generator voltage which may range between 18 and 38 volts can also be monitored.

For all of these monitoring systems, eight-track data transmission and evaluation can be used, each data track being represented by a respective pulse train 35, 36, etc. The transmsitter electronics in the circuit 16 receives the eight measured values in terms of voltages varying ±5 volts or 0 to 5 volts and converts the voltages to respective trains of pulses of different frequencies or periods and, utilizing these principles and the pulse spacings to distinguish between the channels or the eight channels to be transmitted, nine pulses can be generated to signal all of the parameters before recycling and repetition for another train of nine pulses for the eight channels. The electrical pulses are applied to an output transmitter, e.g. an output transister which triggers the magnetic valve 11 in a corresponding cadence with the resulting hydraulic impulses being detected by the converter 29 in the manner described.

The converter 29 can use a differential pressure pickup with a sensitivity of 40 to 100 m bar and with a voltage supply of 10 to 40 volts at the output side, current pulses can be generated by the converter of 0 to 20 mA. This output can be delivered by a two-wire cable connected to the converter 29 at a remote recording and evaluating station without concern for the length of the cable.

At the receiver side 8 channels with a voltage supply of 24 volts can be provided. The receiver converts the remotely transmitted current pulses to voltage pulses which are serially evaluated in terms of the time interval between the pulses to establish the voltage values. The output can be given in parallel on eight digital displays.

To identify the pulses from the transmitter to the receiver, before each sequence of nine pulses, 2 synchronizing pulses are generated with a constant interval between them. These synchronizing pulses serve to synchronize the transmitter and the receiver. Only after receipt of the synchronizing pulses is the receiver responsive to the measuring pulses, thereby eliminating transmission errors.

The transmission precision at ±5 volts is about 156 mV or about 1.5%.

For an inclination in the measurement range of ±10, this corresponds to an error of ±1 minute of arc corresponding to the measurement precision of conventional inclinometers.

Figure 9:
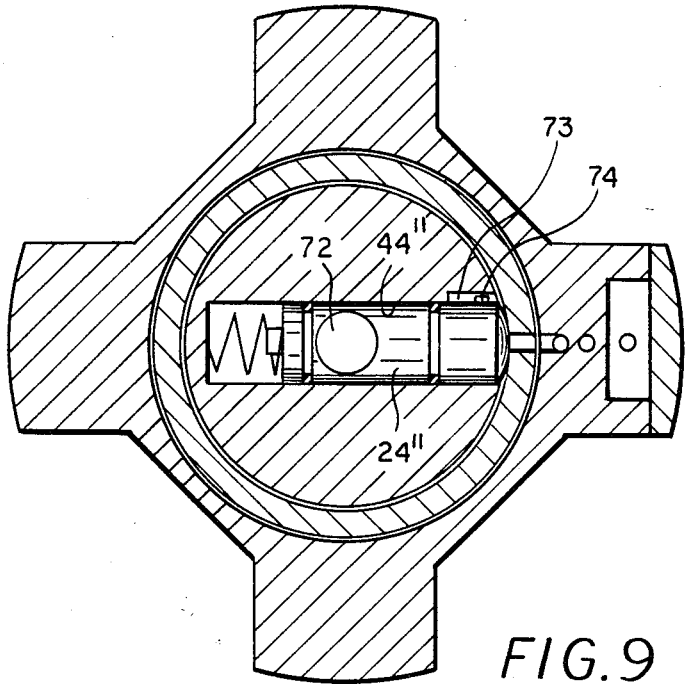
FIG. 9 is a view similar to FIG. 2 showing a modification of the spindle piston.
Figure 10:
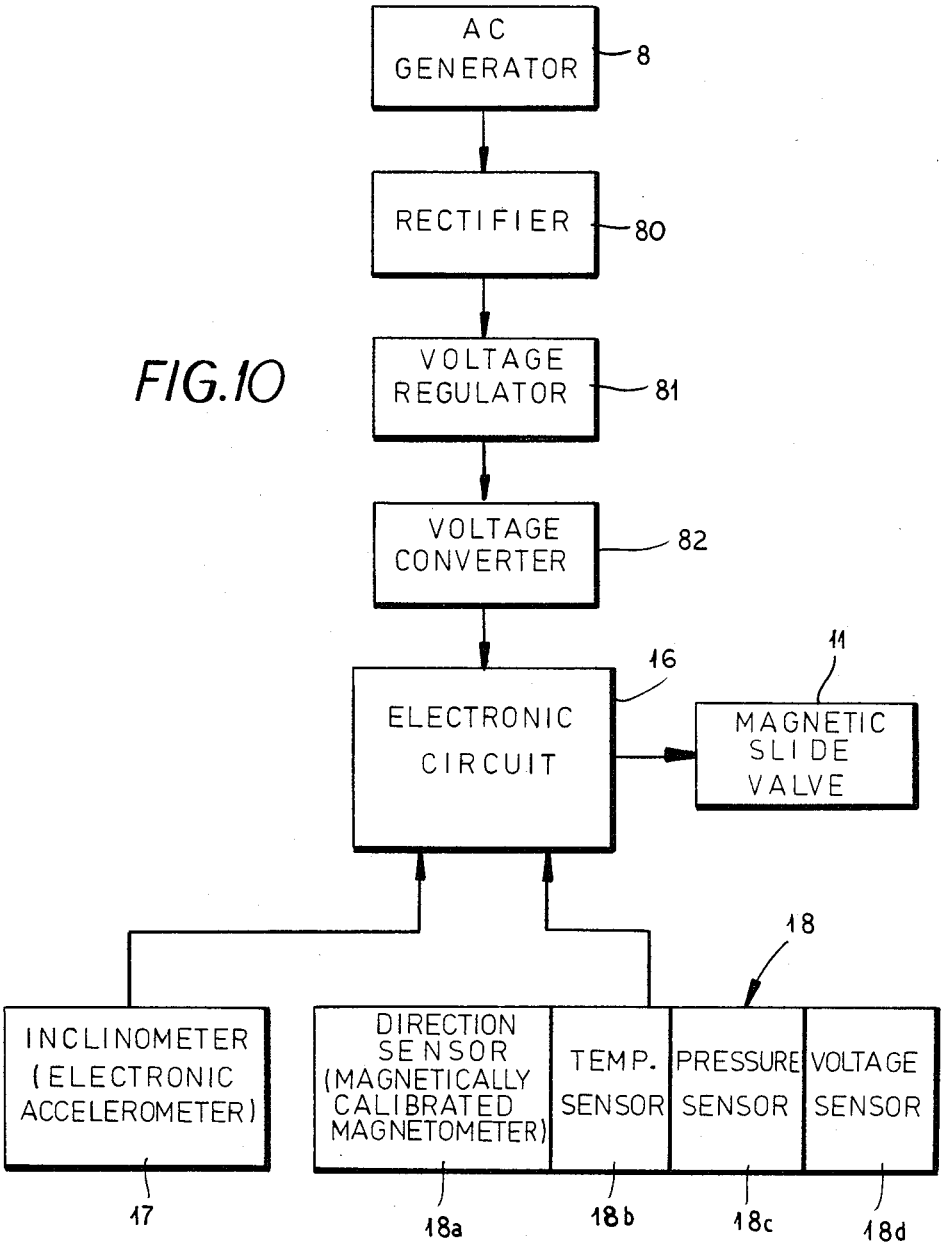
FIG. 10 is a circuit diagram showing the electrical and sensory elements provided in the drilling head.

In the embodiment of FIG. 9 the diameter of the recess 44'' for the spindle piston 24'' is larger than the diameter of the flushing passage 3 which intersects the recess. The spindle piston 24'' has a cutout 72 which has the same circumference and cross section as the flushing passage. A groove 73 in the wall of the recess 44'' cooperates with a cam 74 on the piston 24 so that angular displacement of the piston about its longitudinal axis is prevented and, in the neutral position of the piston, the cutout 72 will register prefectly with the flushing passage. The spindle piston 24" is displaced in the manner described to briefly intercept or obstruct the mud flow. In this embodiment, therefore, in the neutral position of the piston the mud flow passage is not obstructed at all.

We claim:

1. A dirigible drill string comprising:

an elongated drill head formed with;

an inner tube carrying a drilling bit and defining a flushing liquid passage, an outer tube coaxially surrounding said inner tube, hydraulic means responsive to the orientation of said head for controlling the progress of the string in a bore to be formed by said string, at least one sensor in said head for signalling a status condition thereof, a recess formed in said inner tube across said passage a spindle piston displaceable in said recess, and an electronic circuit in said head responsive to said sensor for controlling said spindle piston and momentarily displacing same back and forth to form a train of pressure pulses in a flushing liquid traversing said passage;

a plurality of further drilling tubes connected in series to said head for delivering a flushing liquid to said passage; and means responsive to pressure pulses in said flushing liquid and disposed at a location remote from said head for evaluating said train of pulses and ascertaining a value of a parameter representing a condition of said head.

2. The dirigible drill string defined in claim 1, further comprising a spring acting upon said spindle piston and biasing same in one direction out of obstructing relationship with said passage, said electronic circuit including a valve hydraulically connected to said recess for applying a hydraulic pressure pulse to said spindle piston in a direction opposite said spring.

3. The dirigible drill string defined in claim 2 wherein said recess for said piston spans said passage and said piston has a pair of portions connected by a spindle shaft extending across said passage.

4. The dirigible drill string defined in claim 2 wherein said piston is located on one side of said passage in said recess.

5. The dirigible drill string defined in claim 2, further comprising a sealing sleeve surrounding said inner tube and rotatable therewith said sleeve being formed with seals disposed on axially opposite sides of respective grooves communicating between said valve and said recess.

6. The dirigible drill string defined in claim 5 wherein said head is provided with a plurality of sensors including at least one inclinometer, at least one direction sensor, at least one temperature sensor, at least one pressure sensor and at least one voltage sensor all connected to said electronic circuit and producing respective trains of hydraulic pulses in said flushing liquid.

7. The dirigible drill string defined in claim 2 wherein said means responsive to pressure pulses includes a differential pressure pickup connected to a duct delivering said flushing liquid to said passage and a display connected to said differential pressure pickuup.

8. The dirigible drill string defined in claim 2 wherein said head is provided with a generator producing electric current on rotation of said inner tube, a rectifier connected to said generator, a voltage regulator connected to said rectifier and a voltage converter for energizing said electronic circuit and a transmitter forming part thereof.

9. The dirigible drill string defined in claim 8 wherein said means responsive to said pressure pulses includes a receiver, said transmitter and receiver being synchronized by at least one synchronizing pulse forming part of said train.

10. The dirigible drill string defined in claim 2 wherein said head is provided with an inclinometer in the form of an electronic accelerometer and with a direction detector constituted by a magnetically calibrated magnetometer.

11. The dirigible drill string defined in claim 2 wherein said outer tube is provided with at least one gamma ray sensor.

12. The dirigible drill string defined in claim 2 wherein said spindle piston is formed with a bore normally registering with said passage and offset therefrom upon hydraulic actuation of said spindle piston.

13. The dirigible drill string defined in claim 2 wherein said valve is connected to an electrically operated hydraulic pump formed in said outer tube.

14. The dirigible drill string defined in claim 13 wherein said bit is operatively connected to said inner tube and is rotatable therewith.

15. The dirigible drill string defined in claim 14 wherein said outer tube is provided with a three-phase electrical generator having a rotor provided with a pinion gear, said outer tube being externally toothed and meshing with said pinion gear.

* * * * *